US005204491A

United States Patent [19]

Auréal et al.

[11] Patent Number: 5,204,491

[45] Date of Patent: Apr. 20, 1993

[54] PYROTECHNIC DETONATOR USING COAXIAL CONNECTIONS

[75] Inventors: Thierry Auréal, Poitiers; Joël Bansard, Marcilly en Vilette; Gérard Humily; Christophe Rivière, both of Orleans, all of France

[73] Assignee: Thomson — Brandt Armements, Boulogne Billancourt, France

[21] Appl. No.: 792,422

[22] Filed: Nov. 15, 1991

[30] Foreign Application Priority Data

Nov. 27, 1990 [FR] France ..... 90 14785

[51] Int. Cl.[5] ..... F42B 3/12

[52] U.S. Cl. ..... 102/202.14; 102/202.9; 102/202.8

[58] Field of Search ..... 102/202.9, 202.5, 202.7, 102/202.8, 202.11, 202.13, 202.14, 472

[56] References Cited

U.S. PATENT DOCUMENTS

| | | | |
|---|---|---|---|
| 2,972,951 | 2/1961 | Stresau | 102/472 |
| 3,682,096 | 8/1972 | Ludke et al. | 102/202.9 |
| 4,354,432 | 10/1982 | Cannavo et al. | 102/202.7 |

FOREIGN PATENT DOCUMENTS

| | | | |
|---|---|---|---|
| 143071 | 5/1985 | European Pat. Off. | 102/202.5 |
| 2013677 | 4/1970 | France | 102/202.9 |
| 2506927 | 12/1982 | France | 102/202.5 |
| 1419775 | 12/1975 | United Kingdom | 102/472 |
| 2006402 | 5/1979 | United Kingdom . | |
| 2100395 | 12/1982 | United Kingdom . | |

*Primary Examiner*—Stephen M. Johnson
*Attorney, Agent, or Firm*—Roland Plottel

[57] ABSTRACT

This detonator includes a cylindrical anvil of dielectric material bearing on one face an area of electrical contact and on the other a fusible bridge of which one end is connected to the area of electrical contact via a plugged conducting hole and of which the other end is connected to an annular conducting area around the edge of the anvil. A cylindrical hollow plug is connected to the anvil by a flanged ring soldered to the plug and to the annular conducting area of the anvil. Around this plug is fitted a cylindrical flexible contact part. A closing cylinder is soldered to the plug. Inside the plug are fitted a disk of plastic material, a barrel, and an explosive charge in a case. The assembly is closed by a cap laser welded to the closing cylinder. The invention is applicable to hermetic detonator structures for initiation in particular of warheads, propellors of rockets, missiles or other guided projectiles, or of gas generators.

17 Claims, 2 Drawing Sheets

PYROTECHNIC DETONATOR USING COAXIAL CONNECTIONS

BACKGROUND OF THE INVENTION

This invention concerns a pyrotechnic slapper-detonator with coaxial connections.

Such detonators, also known as EFIs ("Exploding Foil Initiators"), can be used in particular to initiate warheads or propellers of rockets, missiles or all guided projectiles, or gas generators (in the latter case the initiators are known as igniters).

In the field of detonation, i.e. explosives, solid warheads can be initiated, for example, by a violent projection of material on to an intermediate charge causing the initiation of this charge. This projection is produced by an explosion of a vaporizable metal film, this explosion being generally obtained by two different processes:

either by passing an electric current pulse, or by absorption of a pulse of light generated by a laser.

The present invention concerns in particular the first of these methods: the material to be projected is placed on the conducting element. To trigger the device an electrical discharge of very short duration but high intensity is passed through this element. The material is then projected against the intermediate charge, its kinetic energy causes initiation of this charge.

One embodiment of this type of detonator, described in French patent application No. 87 08813, filed on Jun. 23 1987, includes an electrical element comprising two strands connected at their ends and placed sufficiently close to each other to constitute a conductor of low inductance. This electrical element penetrates the wall of the device at least one point to be able to connect it to an external electrical supply. This flat connector is difficult to fabricate and is fragile. Moreover the construction of such a system involves problems of integration, size and gas-tightness. Another category of detonator, described in the same patent application, includes an electrical element whose electrical supply is via two electrodes perpendicular to the element. In this system the size of the device, although smaller than the first embodiment, is still large. There also remain problems of gas-tightness in this system which can result in deterioration, for example corrosion of the electric element.

To remedy these problems, the Applicant proposed in French patent application No. 89 07675, filed on Jun. 9, 1989, a pyrotechnic slapper-detonator or initiator including coaxial connections. Such a system has many advantages, in particular as regards the gas-tightness of the electric element (allowing prolonged storage), rigid construction, very simple assembly and relatively low cost. Such a detonator remedies the problems mentioned earlier.

SUMMARY OF THE INVENTION

The object of the present invention is to improve this last-mentioned invention, using the same principles but with significant improvements as regards simplicity, mechanical strength and cost, thanks to a lighter, more compact structure.

The invention therefore relates to a pyrotechnic detonator with coaxial connections of a type including electrical projected-layer control means, comprising a barrel, a first cylindrical element forming an anvil and an assembly comprising a fusible bridge, on which is disposed a thin layer of a material, located between the first cylindrical element and the barrel, and electrical supply means for said control means, including at least one conducting surface situated on the bottom of the anvil and hermetic electrical crossing means for connecting said conducting surface to one end of said fusible bridge through said anvil, and pyrotechnic means initiated by said electrical projected-layer control means, wherein said detonator also includes a second non-conducting cylindrical element in the form of a hollow plug of which one end presses against said anvil and the other end has a guide shoulder, a cylindrical flexible contact part being fitted around said plug between said shoulder and the circular edge of the anvil, wherein hermetic assembling means are provided between said plug and said anvil, and wherein hermetic closing means are provided for hermetic sealing of said detonator, these closing means being fixed at the end of said plug having said shoulder and holding the pyrotechnic means inside said plug against said barrel.

The invention also includes an assembly method for the detonator described above, characterized by the fact that it includes the following steps:

assembling the plug and a closing cylinder by high-temperature soldering of the cylinder on the inner metallized surface of the plug;

assembling the plug and a flanged ring by low-temperature soldering of this ring on the metallized lateral outer surface of the plug;

fixing this plug/ring assembly to said anvil by soldering the flange of the ring to the anvil;

assembling said cylindrical flexible contact part on said lateral outer surface of the plug;

placing successively inside the plug said thin layer of material, the barrel and said pyrotechnic means; and fitting a cap on the closing cylinder, compressing the elements placed in the plug, and fixing it to the closing cylinder by laser welding.

BRIEF DESCRIPTION OF THE DRAWINGS

The invention will be better understood and other characteristics and advantages will appear on reading the description below with reference to the appended drawings in which.

DESCRIPTION OF THE PREFERRED EMBODIMENT

Figure 1:
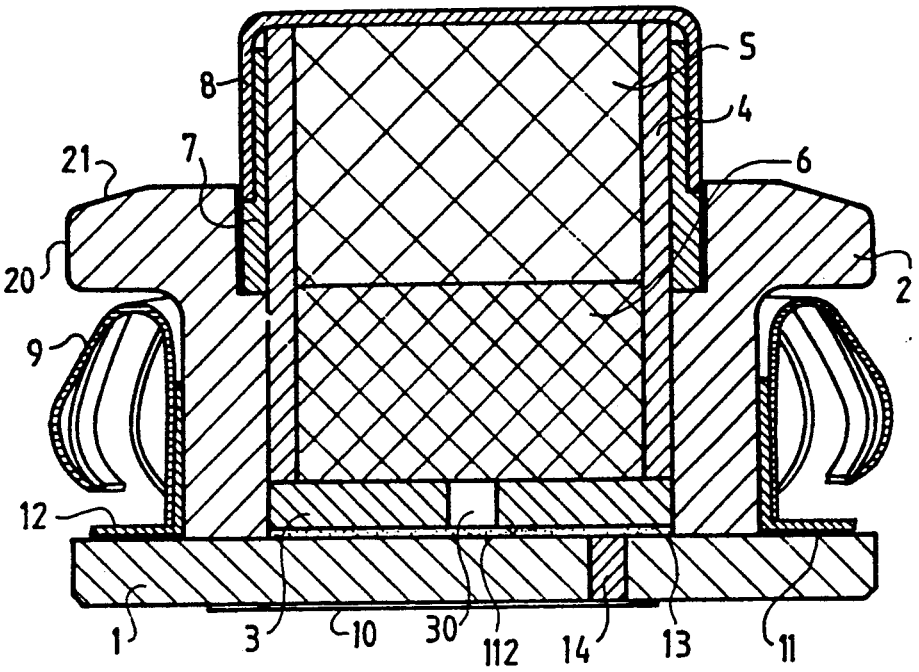
FIG. 1 shows a section of a first embodiment of the detonator according to the invention.

The detonator according to the invention is a slapper-detonator (also known as Exploding Foil Initiator). It includes, as do other devices of this type described briefly above, an electrical circuit enabling an electric pulse of several thousand amperes lasting a few tens of nanoseconds to volatilize a part of a metallic conductor (fusible bridge) and form a metallic plasma. The violent expansion of this confined plasma is used to project on to the face of a secondary explosive a projectile comprising a disk of plastic material a few tens of microns thick and about 1 millimeter in diameter. The initiation of the secondary explosive charge of the detonator is assured by the very high speed impact of this projectile on the explosive. FIG. 1 shows a section of an embodiment of the detonator according to the invention based on these operating principles. This detonator includes essentially a metallized cylindrical anvil supporting a fusible bridge 112, a cylindrical plug 2 of dielectric material, electrical projected-layer control means including the fusible bridge, a thin layer of material 13 and a mechanical confinement provided by a barrel 3 with a hole 30, pyrotechnic means 4, 5 and 6 and a cap 8 closing the assembly. The plug is fixed to the anvil by an intermediate part 12 in the form of a flanged ring.

Figure 2:
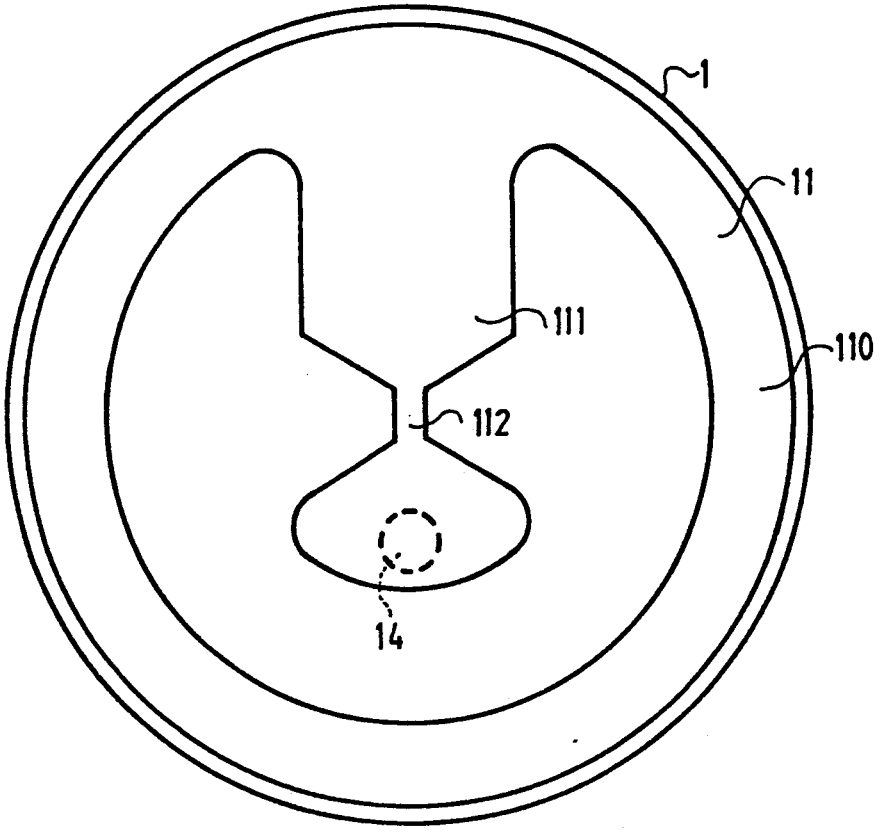
FIG. 2 is a view of the top of the anvil of the detonator in FIG. 1.

The anvil 1 is for example a cylindrical alumina part having on its bottom face a conducting surface 10 in the form of a disk, for example, which serves as an area of electrical contact. On the other face of the anvil 1 is formed, as shown in FIG. 2, the fusible bridge 112 of which one end 111 is connected to a surrounding annular conducting surface 110 and of which the other end is connected to the conducting surface 10 by at least one hermetic electrical crossing 14 in the form, for example, of a metallized hole filled or plugged by a conducting part. The whole conducting surface 11, comprising the surface 110 and the fusible bridge 111, 112 is made by vacuum metallization, for example.

The plug 2 (FIG. 1) is a turned part, of alumina for example, with a cylindrical body and a guide shoulder 20. The plug 2 is connected to the anvil 1 by the flanged ring 12, for example by soldering, the flange being soldered to the surface 110 of the anvil 1 The upper face (in the position shown in FIG. 1) of the guide shoulder 20 has a bearing surface 21 intended to transmit pressure to the contact surface 10 of the detonator to assure electrical contact with an external housing not shown in the figure In the end of the plug 2 adjacent to the shoulder 20 is fixed, by soldering for example, a closing cylinder 7. This cylinder can in particular be of stainless steel. Within the plug 2 is placed a disk 13, of polyimide for example, known as a "flyer". This disk is held in place against the fusible bridge on the anvil 1 by the barrel 3 which can also be of alumina.

The pyrotechnic means comprise a case 4, of stainless steel for example, containing an explosive charge including two secondary explosives 5 and 6. The assembly including the disk 13, the barrel 3 and the pyrotechnic means 4, 5 and 6 is compressed against the anvil 1 by the cap 8 fixed to the closing cylinder 7.

Around the body of the plug 2 and the ring 12 is placed a cylindrical flexible contact part 9. This part 9 comprises a cylindrical part in contact with or soldered to the ring 12 and flexible contacts bent backwards. Part 9 is thus linked electrically to the end 111 of the fusible bridge via the ring 12 and the annular conducting surface 110 of the anvil 1.

It is seen that the assembled detonator can very easily be introduced into a cylindrical housing having a conducting bottom and conducting lateral internal faces which provide the two electrical contacts for the initiation system and which are in contact respectively with the contact surface 10 and the flexible contacts of part 9 of the detonator. It is therefore very simple to slide the detonator from the housing, for example to carry out tests.

We shall now describe more precisely the fabrication of the main parts constituting the detonator according to the invention. The anvil 1 is made from a substrate of alumina of large dimensions. Holes are drilled in the substrate and are filled with copper to form the hermetic electrical crossings 14, either by soldering a copper rod in each hole, after metallizing their inner surfaces, or by filling the holes by aspiration of a screen printing solder paste. After grinding both faces of the alumina substrate these are metallized by cathodic sputtering. A primary layer of chrome a few tenths of nanometers thick can first be applied to assure adherence, followed by a layer a few microns thick of copper on the same side as the fusible bridge. On the other face the metallization preferably includes also a layer of gold a few microns thick to protect the contact surface 10. The required geometries of the circuits on the two faces are then obtained by chemical etching. Finally, anvils are cut by laser from the substrate.

The plug 2 is also of alumina and can be turned from the block or formed by sintering followed by grinding. The plug is metallized on its lateral outer surface and on its inner surface at the end adjacent to the guide shoulder. The closing cylinder 7 is high-temperature soldered to the plug, then the flanged ring 12 is low-temperature soldered to the plug. The cylindrical part 9 can be made from a band of copper-beryllium alloy in which the contact strips are cut. After forming the contact strips the band is rolled into a cylinder and cut to length. The open ring thus obtained is annealed to stabilize the mechanical properties, in particular the elasticity. It can be gold-plated to assure protection against corrosion.

The pyrotechnic means comprise a cylindrical case 4 of stainless steel in which the explosive charge is placed. This includes a first secondary explosive 6 which receives the impact of the plastic projectile and can be HNS (hexanitrostylbene). Its detonation is reinforced by a second secondary explosive 5 which can be RDX-wax, for example. These explosives are loaded in the case under compression up to a given depth. The use of two explosives is, of course, suggested only as an example The assembly of the detonator according to the invention is carried out in two stages assembly of the inert part (anvil, plug, flexible contact part, closing cylinder), followed by fitting of the plastic disk 13, the barrel and the charged case. Finally, the assembly is closed using the cap.

During the first assembly step, the closing cylinder 7 is soldered at high temperature to the plug 2, then the flanged ring 12 is soldered at low temperature to the plug. The metallized anvil is fitted by soldering the flange of the ring 12 on the surface 110. Next the cylindrical flexible contact part 9 (split cylinder) is fitted around the body of the plug 2 and the ring 12 where it is held in contact simply by its elasticity or by soldering.

During the second assembly step, the disk of plastic material 13, the barrel 3 and the charged case 4 are successively introduced into the assembly of the first step. The cap 8 covers the assembly and assures sufficient compression of the parts 13, 3, 4, 5 and 6 against the anvil 1 to confine the plasma of copper during operation of the detonator. The cap 8 is fixed to the closing cylinder 7 by laser welding.

Owing to the compression of the parts 13, 3, 4, 5, and 6 by the cap 8, all internal play is eliminated, in particular of the charged case 4, which gives the detonator excellent resistance to vibrations. Furthermore, one of the major advantages of this embodiment of the invention is that it is totally hermetic. Gas-tightness is assured by the soldered joints between the flanged ring 12 and the anvil 1 and the plug 2, between the closing cylinder 7 and the plug 2, by the laser welding of the cap 8 to the closing cylinder 7 and by the hermetic electrical crossings 14 The active parts of the detonator (fusible bridge 112, plastic material 13 and explosive charge 4, 5 and 6) are thus protected from corrosion and aging due to the ambient atmosphere, which enables prolonged storage.

As we have already mentioned, the design of the detonator allows easy fitting and removal, which facilitates maintenance operations and testing of the electronic means of firing.

The lightweight and compact design of the detonator enable it to support the mechanical stresses occurring during the use of munitions in which it could be used.

Another major advantage of the detonator according to the invention is the possibility of automating its fabrication, and therefore of reducing its cost.

Figure 3:
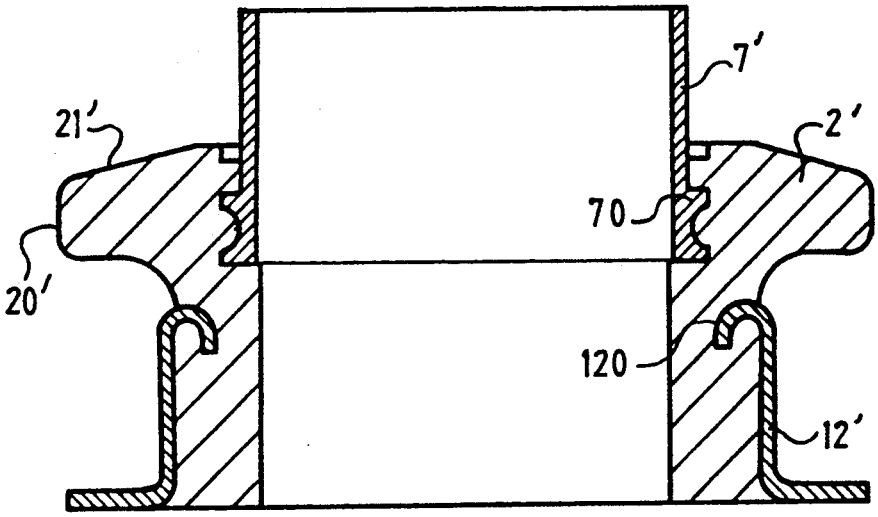
FIG. 3 shows a section of a second embodiment of the detonator according to the invention.

With the objective of reducing the cost of the detonator, in FIG. 3 we present a variant of the invention including a different plug. In FIG. 3 the plug 2', the closing cylinder 7' and the flanged ring 12' are made and assembled in a single operation. To do this the plug 12' is made of plastic material, by injection, the closing cylinder 7' and the flanged ring 12' being inserts in the moulded plug.

FIG. 3 shows, as an example, the possible forms of the flanged ring 12', turned inwards (120) on the side opposite the flange of the ring, and of the closing cylinder 7' incorporating ribs 70 on the outer surface where it is inserted in the plug 2'. The plug 2' includes, like the plug 2 in FIG. 1, a guide shoulder 20' with a bearing surface 21'. The plug 2, with the closing cylinder 7' and the flanged ring 12' has exactly the same functions as the alumina plug 2 assembled with the closing cylinder 7 and the flanged ring 12 in FIG. 1.

The plug 2' can be made from high-performance polymer material, for example by injection of polyetherethercetone (PEEK) charged with glass-fiber to provide excellent mechanical strength. Polyethersulfone (PES) charged with glass-fiber can also be used. The material chosen must withstand high temperatures (200° C. minimum) and be impervious to gas, even at small thicknesses.

Similarly, the anvil 1 can also be made from these same materials using the same technique. In this case the hermetic electrical crossings 14 and the contact surface 10 are then made in the form of inserts. In this case only the fusible bridge and the conducting surface 110 are made by cathodic sputtering and chemical etching.

The fabrication of the detonator according to the invention with the plug and anvil of plastic material is cheaper, yet conserves the same functional advantages. The examples of embodiments given are not, of course, exhaustive. For example, while remaining within the framework of the invention, it would be possible to use a totally cylindrical plug, with part 9 in this case being soldered to the ring 12 or 12'.

What is claimed is:

1. A pyrotechnic detonator with coaxial connections comprising electrical projected-layer control means including a barrel, a first cylindrical element forming an anvil, which has a bottom ana an opposite surface with a circular edge and an assembly including a fusible bridge with two ends and a thin layer of a material disposed on said bridge, said assembly being located between said anvil and said barrel;

electrical supply means for said control means, including at least one conducting surface situated on the bottom of the anvil and hermetic electrical crossing means for connecting said conducting surface to one end of said fusible bridge through said anvil;

pyrotechnic means when initiated by said electrical projected-layer control means;

a second non-conducting cylindrical element formed as a hollow plug having a cylindrical body, and having a first end and a second end, said first end being pressed against said anvil and said second end having a guide shoulder;

a cylindrical flexible contact part being fitted around said plug between said shoulder and the circular edge of the anvil;

assembling means for hermetically sealing said plug to said anvil; and hermetic closing means for hermetically sealing said detonator, said closing means being fixed at said second end of said plug and holding the pyrotechnic means inside said plug against said barrel.

2. A detonator according to claim 1, wherein said assembling means include a metallic flanged ring fixed on a lateral external surface of the cylindrical body of said plug and on said opposite surface of said anvil bearing said fusible bridge.

3. A detonator according to claim 2, wherein said surface of said anvil bearing the fusible bridge includes a peripheral annular conducting surface, one of said ends of said fusible bridge not connected to said electrical crossing means being connected to said conducting surface, and wherein said fusible bridge and said annular conducting surface are formed by a metallic layer on said anvil.

4. A detonator according to claim 3 wherein said metallic flanged ring is soldered to said annular conducting surface and to said plug whose lateral surface has been metallized.

5. A detonator according to claim 2, wherein said hermetic closing means includes a closing cylinder fixed in said second end of the plug adjacent to the guide shoulder and a cap fitting over said closing cylinder and said pyrotechnic means, contained in said plug extended by said closing cylinder, said cap being soldered to the closing cylinder so as to compress said pyrotechnic means, said barrel and said thin layer against said anvil.

6. A detonator according to claim 5, wherein said pyrotechnic means includes a cylindrical case in which is compressed an explosive charge.

7. A detonator according to claim 6, wherein said case is of stainless steel.

8. A detonator according to claim 6, wherein said closing cylinder is soldered to said plug whose internal surface has been metallized at said second end of the plug adjacent to the guide shoulder.

9. A detonator according to any of claims 5 to 7, wherein said plug is of a plastic material and wherein said metallic flanged ring and said closing cylinder are formed by inserts partly embedded in said plug, said metallic flanged ring being soldered to said anvil.

10. A detonator according to claim 9, wherein said anvil is of a plastic material and wherein said hermetic electrical crossing means and said conducting surface on the bottom of the anvil are formed by inserts.

11. A detonator according to claim 10, wherein said plug is of a polyetherethercetone charged with glass-fiber.

12. A detonator according to claim 10, wherein said plug is of a polyethersulfone charged with glass-fiber.

13. A detonator according to claim 2, wherein said cylindrical flexible contact part is fitted around said ring and in electrical contact with it.

14. A detonator according to claim 13, wherein said cylindrical flexible contact part is soldered to a cylindrical surface of said metallic flanged ring.

15. A detonator according to claim 1, wherein said plug and said anvil are of alumina.

16. A detonator according to claim 1, wherein said guide shoulder of the plug has an external surface opposite to said anvil which comprises a bearing surface to transmit a pressure necessary to hold in position said detonator.

17. A detector according to claim 1 wherein said fusible bridge, and said thin layer of material, are aligned with an aperture in said barrel, said aperture extending between said material and said pyrotechnic means.

* * * * *